US005939512A

United States Patent [19]

Gervasi et al.

[11] Patent Number: 5,939,512

[45] Date of Patent: Aug. 17, 1999

[54] FAST CYCLING BLENDED POLYMER MATERIAL COMPRISING NYLON-6

[75] Inventors: Jay A. Gervasi, Succasunna; Harold W. Tuller, Long Valley; Wesley F. Smith; Charles W. Alpaugh, both of Succasunna, all of N.J.

[73] Assignee: AllliedSignal Inc., Morris Township, N.J.

[21] Appl. No.: 09/032,769

[22] Filed: Feb. 28, 1998

Related U.S. Application Data

[63] Continuation of application No. 08/476,292, Jun. 7, 1995, abandoned, which is a continuation-in-part of application No. 08/102,452, Aug. 5, 1993, abandoned, which is a continuation-in-part of application No. 08/823,003, Jan. 15, 1992, abandoned, which is a continuation of application No. 08/526,274, May 21, 1990, abandoned.

[51] Int. Cl.[6] ..... C08L 77/00; C08L 53/02

[52] U.S. Cl. ..... 528/170; 528/310; 528/322; 528/332; 528/335; 528/336; 525/66; 525/92 B; 525/178; 525/183; 525/184; 525/425; 524/504; 524/514; 524/600; 524/606

[58] Field of Search ..... 528/310, 322, 528/332, 336, 335; 324/600, 606, 504, 514; 525/92, 60, 178, 183, 184, 425

[56] References Cited

U.S. PATENT DOCUMENTS

| | | | |
|---|---|---|---|
| 4,174,358 | 11/1979 | Epstein | 525/183 |
| 4,404,312 | 9/1983 | Kokubu et al. | 524/504 |
| 4,820,768 | 4/1989 | Shiraki et al. | 525/92 |
| 5,140,059 | 8/1992 | Simoens | 524/504 |

*Primary Examiner*—P. Hampton-Hightower
*Attorney, Agent, or Firm*—Roger H. Criss; Colleen D. Szuch

[57] ABSTRACT

A composition comprising a polyamide, a polyolefinic modifier, and an ethylene/acrylic acid copolymer.

24 Claims, No Drawings

FAST CYCLING BLENDED POLYMER MATERIAL COMPRISING NYLON-6

RELATED APPLICATIONS

This application is a continuation of U.S. Ser. No. 08/476,292 filed Jun. 7, 1995, now abandoned which was a continuation-in-part application of U.S. Ser. No. 08/102,452 filed Aug. 5, 1993 (abandoned), which is a continuation-in-part of U.S. Ser. No. 08/823,003 filed Jan. 15, 1992 (abandoned), which is a continuation application of U.S. Ser. No. 08/526,274 filed May 21, 1990 (abandoned).

TECHNICAL FIELD OF THE INVENTION

The invention relates to polymer materials used in the production of molded articles; more particularly to molding materials comprising Nylon-6 and other constituents which exhibit fast mold cycling time, and good toughness characteristics. Additionally, the molding material may comprise further constituents including styrene-maleic anhydride copolymer and Nylon-6,6.

BACKGROUND OF THE INVENTION

Engineered materials enjoy widespread popularity for the production of formed articles. Typically, these materials comprise one or more polymers and other materials which exhibit specific properties, i.e., toughness, flexibility, chemical resistance, long-term stability, dielectric strength, etc. Frequently, materials which exhibit particular features such as those listed are used as constituents in formulations of so-called "polymer blends" which comprise a polymer and one or more constituent materials, such as an additional polymer or a non-polymeric material. Frequently, the purpose of the addition of such non-polymeric materials is to enhance the properties of the polymers, by acting as a "compatibilizer" and thus improve the adhesive properties of a polymer with a second "incompatible" polymer, or to impart other specific properties, such as increased toughness, elevated melting temperature, improved product clarity, abrasion resistance, chemical resistance, etc. Unfortunately, as is well known to the art, the formation of blended polymeric materials which feature all of the desirable characteristics of the constituents making up its formulation without simultaneously suffering some detrimental quality are rarely attained.

Exemplary polymeric materials which exhibit satisfactory physical characteristics and good processability include the compositions described in U.S. Pat. No. 4,174,358 for "Tough Thermoplastic Nylon Compositions" to Epstein, which discloses compositions which comprise a polyamide matrix and a second polymer which exhibits good impact toughness; U.S. Pat. No. 4,879,324 for "Thermoplastic Molding Compositions Based On Polycarbonates, Polyesters and Polyamides" to Lausberg et.al. for thermoplastic molding compositions having favorable impact properties; and U.S. Pat. No. 4,160,790 of Mason, et.al. for "High Impact Nylon Molding Compositions" which discloses compositions comprising nylon-6 and nylon-6,6 which feature improved toughness.

Such materials provided in the prior art provide satisfactory solutions to many specific problems, problems which affect not only the considerations attendant upon the final product formed from a molding material, but also the problems peculiar to the production of articles from the material, including handling and processing. One important aspect of any production process is the time required to form each article, which is strongly dependent upon the characteristics of the particular composition being used. While materials known to the art provide satisfactory operating and performance characteristics suitable to many applications, the mere plurality of these available compositions demonstrates not only their great utility, but also the continuing need to provide new materials exhibiting yet further improved characteristics.

Accordingly, it is an object of the invention to provide new compositions of polymeric materials comprising Nylon-6 which feature excellent physical characteristics, and superior processing features.

SUMMARY OF THE INVENTION

The instant invention is directed to new compositions of molding materials suitable for the production of molded articles; more particularly the invention relates to molding materials comprising a polyamide such as Nylon-6, a polymer selected from the group consisting of polypropylene, propylene copolymers, polyethylene, ethylene copolymers, and blends thereof, whereby the polymer is functionalized and has a tensile modulus greater than 15,900 psi at 25° C. (hereinafter referred to individually and collectively as "polyolefin modifier"), and optionally a modified ethylene-methacrylic acid copolymer. As used herein, "modified ethylene-methacrylic acid copolymers" include such copolymers which are partially neutralized with alkali or alkaline earth ions. Additionally, the compositions may further include other constituents such as coloring agents, lubricants, plasticizers, mold releasing agents, nucleating agents, etc. Additionally, the use of co-modification agents is contemplated. Unlike the Nylon-6 compositions known to the art, the compositions according to the present invention have been observed to exhibit excellent toughness as-exhibited by Izod test values frequently in excess of 10, and relatively short mold retention time required for the production of formed articles therefrom.

DESCRIPTION OF THE PREFERRED EMBODIMENTS

In accordance with the present invention, the properties of unmodified polyamides are improved by the addition of quantities of a functionalized polyolefinic modifier, i.e. a maleated polyolefin modifier, and optionally an ethylene-methacrylic acid copolymer. A critical requirement of the functionalized polyolefinic modifier is that is non-elastomeric. As used herein, a "non-elastomeric" material is one which has a tensile modulus of greater than 15,900 psi at 25° C. In the preferred embodiments of the invention, the functionalized polyolefin modifier exhibits a tensile modulus equal to or greater than about 30,000 psi at 25° C. The functionalized polyolefin modifier more preferably exhibits a tensile modulus equal to or greater than about 50,000 psi at 25° C., and most preferably exhibits a tensile modulus equal to or greater than about 70,000 psi at 25° C. In the embodiments of choice, the functionalized polyolefin modifier exhibits a tensile modulus equal to or greater than about 85,000 to 90,000 psi at 25° C. As is well known in the art, maleic anhydride may be used as a reactant with the polyolefin modifier to form a grafted copolymer exhibiting adhesive properties, said copolymer being the maleated copolymer comprised of the reaction product between the polyolefin modifier and the maleic anhydride.

Any propylene or ethylene copolymer can be used as the polyolefinic modifier in the practice of this invention. Illustrative of such suitable polyolefin modifiers include polypropylene, polyethylene, and blends and copolymers comprising propylene and/or ethylene and/or other alpha-beta-unsaturated monomers or diene monomers such as butadiene and isobutylene, and 1-butene and the like. Preferred for use in the practice of this invention is a blend of polypropylene and polyethylene. More preferred is a blend of polypropylene with maleated polyethylene, or a blend of polypropylene with a maleated copolymer of ethylene and 1 -butene.

In a preferred embodiment, the polyolefinic modifier is comprised of, based upon the total weight of the modifier, from about 25 to about 75, preferably from about 45 to about 55 of polypropylene blended with from about 25 to about 75, and preferably from about 45 to about 55 of ethylene copolymerized with from about 0 to about 5%, preferably from about 0 to about 2% 1-butene, and whereby the copolymer is modified with, based upon the total weight of polyolefinic modifier, from about greater than 0 to about 2%, and preferably from about 0.3% to about 0.5% maleic anhydride.

Suitable functionalized polyolefinic modifiers can be prepared using conventional techniques or obtained from commercial sources. For example, suitable maleated polyolefinic modifiers may be obtained from Quantum Chemical Corporation, Cincinnati, Ohio ("Quantum") under the trade name "PLEXAR", a U.S. registered trademark for a family of extrudable adhesive resins which are marketed for use as a tie layer between dissimilar polymer films. One especially suitable maleated polyolefinic modifier is marketed under the trademark "PLEXAR PX 420" from Quantum. This particular PLEXAR is described as a modified, polypropylene-based adhesive resin which provides excellent bonding between polyethylene or polypropylene, and Nylon or ethylene vinyl alcohol copolymers; typically exhibits a melt flow rate of 2.5 g/10 min. when tested according to test method ASTM D-1238, and exhibits a density of 0.918 g/cc tested according to test method ASTM D-1505. It is believed that this PLEXAR comprises a blend of isotactic polypropylene and modified ethylene-1-butene copolymer, wherein the ethylene unit is grafted with maleic anhydride. (Hereinafter, this composition will be referred to as "ethylene-propylene blend"). The addition of the maleated polyethylene-polypropylene blend primarily imparts the improvement of reducing the mold cycling time required in the production of articles utilizing materials according to the present invention, and contributes to imparting improved toughness, i.e. impact resistance to the otherwise unmodified Nylon-6.

It is believed that the inclusion of the maleic anhydride is needed for the practice of the teaching of the instant invention as it is hypothesized that the maleic anhydride provides a reactive site to which the Nylon may be attached. Other suitable reactive sites which find use in accordance with the present invention include itaconic anhydride, glycidyl methacrylate, acyl bislactams, oxazolines, and related compounds, as listed in J.Appl.Polymer Science Vol.30, p.3325 et.seq.(1985) as well as oxazinones and related compounds as listed in J.Appl.Polymer Science Vol.32, p.4581 et.seq.(1986), both of which are herein incorporated by reference.

Suitable modified ethylene-methacrylic acid copolymers ("E/MAA") which may be used in the practice of the instant invention are those which are the reaction product between an ethylene-methacrylic acid copolymer which is partially neutralized with alkali or alkaline earth ions, such as zinc, sodium, magnesium or lithium.

Suitable modified ethylene-methacrylic acid copolymers are presently commercially available from the E. I. DuPont de Nemours Company, and are sold under the trademark "SURLYN," and are used as blending additives to polymers in order to improve the toughness of the polymer. Preferably, the modified ethylene-methacrylic acid copolymer selected from amongst the available SURLYNs should be those which have a relatively higher degree of neutralization, i.e. greater than about 30% based upon the acid component. Generally, all SURLYNs will exhibit a beneficial effect, but the SURLYNs which have moderate to greater percentages of acid, i.e. greater than about 8% based upon the total acid component (both neutralized and unneutralized), and higher percentages of neutralization are to be generally preferred in the practice of the invention. A commercially available, more preferred modified ethylene-methacrylic acid copolymer is "SURLYN 1801" which has been advantageously employed in the use of the present invention.

The selection of the relative proportions of these constituent materials, which may also be termed the "initial polymer mixture," may be in any desired proportion in order to achieve the desired physical properties in any molded article to be ultimately produced from the initial polymer mixture. What "desired physical properties" is intended to mean is a set of satisfactory physical properties, i.e. satisfactory toughness and handling required for a particular application in conformity with the object of the present invention.

It has been found that the objects of the present invention may be realized when the initial polymer mixture having respective weight percentages relative to the total weight of the composition, is comprised of: 1) from about 51% to about 75%, of polyamide, and preferably nylon 6, although percentages up to about 90% are contemplated as being useful; 2) from greater than about 0% to about 25%, and preferably from about 5% to about 25% functionalized polyolefinic modifier; and 3) from about 0% to about 20%, and preferably from about 5 to about 20% of modified ethylene-methacrylic acid copolymer. This convention of weight percentages relative to the total weight of a composition will be used hereinafter, and any percentages are to be understood as such, unless specifically noted to be otherwise.

Preferably, the sum of the relative weight ratios of the functionalized polyolefinic modifier and the modified ethylene-methacrylic acid copolymers, which are partially neutralized with alkali or alkaline earth ions, comprise greater than about 16% of the three constituents, although a sum of relative weight ratios as low as 10% is contemplated as being useful, and it has also been found that increasing the relative weight ratios has the desired effect of improving the characteristics of the material formed therefrom. The most advantageous range for the sum of these two constituents has been found to be from about 20% to about 24%.

It has also been found that the ratio of the functionalized polyolefinic modifier to the modified ethylene-methacrylic acid copolymer allows for a significant range of variation without detracting from the improved toughness and handling properties of the product molding material. This ratio between the maleated ethylene-propylene mixture and the modified ethylene-methacrylic acid copolymer can be adjusted so that the ratio varies between extremes of about 5% and about 95% functionalized polyolefinic modifier to ethylene-methacrylic acid copolymer which would be contemporaneously be present in a ratio of between about 95% and about 5%. This variation in the ratios allows for the adjustment of the physical properties of the product material to have a degree of toughness in conformance with the particular need of a final molded article, while preserving the improved processability and handling of the material to be used for molding. Such a variation allows for the respective resultant properties, i.e., increased toughness imparted by increasing amounts of modified ethylene-methacrylic acid copolymer included as a constituent, which is balanced by a decrease in the residence time of the material in a mold used to produce an article, which is attendant upon increasing amounts of functionalized polyolefinic modifier incorporated into a polymer material.

Additional constituents may be added to the composition in order to further improve the characteristics of the material. These include such modifiers or other agents known to the art for imparting a particular effect upon a polymer and include plasticizers, viscosity stabilizers, mold release agents, fillers, nucleation agents, etc., which may be incorporated in any amount not found to have a detrimental effect upon the enjoyment of the instant invention.

Further, amounts of different polyamides may also be incorporated in the present invention. In a particular embodiment, a quantity of Nylon-6,6 in an amount which is to substitute up to about 10% of the Nylon-6 constituent may be used. A suitable Nylon-6,6 should have amine end groups which will act to provide additional grafting sites for the functionalized polyolefinic modifier and the modified ethylene-methacrylic acid copolymer. It is preferred that the Nylon-6,6 comprise a preponderance of amine end groups, preferably in excess of about 75%. It should be noted that the substitution of this relatively low amount of the Nylon-6,6 assures that Nylon-6 remains the major constituent used to form materials according to the instant invention. Examples of commercially available Nylon-6,6 having desirable numbers of amine terminal groups are marketed under the tradename "Polynil 50" and "Polynil 60" which are available from NILIT, Ltd of the Netherlands.

As an alternative to, or in addition to a quantity of Nylon-6,6 with a preponderance of amine end groups, it has also been found to be advantageous to provide Nylon-6 with a preponderance of amine end groups as a constituent. This is because the amine end groups of the Nylon-6 provide additional grafting sites for the functionalized polyolefinic modifier. Such a Nylon-6 should have an preponderance of amine end groups relative to the acid end groups, and is preferably in a proportion of amine to acid end groups of at least about 70/30, with ratios of about 80/20 found to be advantageous, although a ratio of about 70/30 is most preferred. Such a Nylon-6 is known to the art and is frequently available as an intermediate.

A second constituent which may be added is a styrene maleic anhydride copolymer in an amount of up to about 1.0% of the total mixture. The styrene maleic anhydride is a useful viscosity increasing additive which exhibits the desirous effect on the product polymer mixture of improved shape retention under high temperature conditions. A suitable styrene maleic anhydride which is commercially available is marketed under the designation "SMA 3000" by the Sartomer Company of West Chester, Pa., U.S.A. This material is described as being a low molecular weight copolymer of styrene and maleic anhydride. A similar material in anhydride and in partial ester form may also be used and is designated as "SMA 2625".

Further, the compositions of the present invention may include conventional additives in small amounts, such as less than 5% of a metal soap as a mold release agent or extrusion aid, and optionally a heat stabilizer such as a stabilizer based on copper. Further, plasticizers may be included, such as caprolactam monomers and water-extractable oligomers or sulfonamide plasticizers in amounts preferably not to exceed 15% of the Nylon constituent. Further, other additives not specifically enumerated here may be incorporated in compositions according to the invention and are recognized as suitable for use as an additional constituent.

It has been found that articles formed from compositions according to the invention feature exceptionally tough compositions and reduced "cycle time", i.e., retention time for the composition within a mold during the forming process as compared with compositions comprising Nylon-6 known to the art.

The compositions of the present invention may be prepared by techniques well known to those skilled in the art including but not limited to the formation of a thermoplastic melt of the constituents, followed by a molding operation. Other methods for forming articles according to the compositions of the present invention may be utilized as desired.

The following non-limiting examples are embodiments of the invention setting forth modes for carrying out the invention, and are not meant to be more limiting than the appendant claims.

EXAMPLES 1–9

The compositions used in Examples 1–9 are comprised of Nylon-6 having balanced end groups and optionally either "Polynil 50", a Nylon-6,6 which is characterized to have unbalanced end groups, or a second nylon-6 which is characterized to have an excess of amine to carboxyl end groups, preferably in a proportion of at least 70/30 and which is referred to in the Examples as "B-1". "SURLYN 1801", "PLEXAR 420", "SMA 3000" and "Acrawax C" were dry blended with the relative weight percentages to form compositions according to those outlined in Table 1. "SMA 3000" is a copolymer of styrene and maleic anhydride. "Acrawax C" is ethylene-bis-stearamide.

TABLE 1

| Sample: | 1 | 2 | 3 | 4 | 5 | 6 | 7 | 8 | 9 |
|---|---|---|---|---|---|---|---|---|---|
| Composition: | | | | | | | | | |
| Nylon-6 | 68.1 | 68.1 | 68.1 | 68.1 | 68.1 | 68.1 | 75.4 | 75.4 | 75.4 |
| Polynil 50 | 7.3 | 7.3 | 7.3 | — | — | — | — | — | — |
| B-1 | — | — | — | 7.3 | 7.3 | 7.3 | — | — | — |
| SURLYN 1801 | 12 | 12 | 12 | 12 | 12 | 12 | 12 | 12 | 12 |
| PLEXAR 420 | 12 | 12 | 12 | 12 | 12 | 12 | 12 | 12 | 12 |
| SMA 3000 | 0.4 | 0.4 | 0.4 | 0.4 | 0.4 | 0.4 | 0.4 | 0.4 | 0.4 |
| Acrawax C | 0.2 | 0.2 | 0.2 | 0.2 | 0.2 | 0.2 | 0.2 | 0.2 | 0.2 |

The respective constituents were dry mixed, after which they were melted and processed in a Leistritz twin screw extruder to form a blended composition. The temperature of the zones was typically as follows: zone 1; 210 deg.C., zone 2 through zone 5; 250 deg.C., zone 6, 230 deg.C. The exit die was maintained at a temperature of 255 deg.C. For these examples, all the constituents were introduced at a hopper located at the throat of the twin screws, and the feed rate was maintained at one of two rates, 25 or 55 lbs./hr. The composition was extruded through the exit die to form strands, which were subsequently quenched in a water bath, then pelletized. The pellets were dried, and then provided to an Arburg injection molding machine which was outfitted with a mold for the formation of standard sized ⅛-inch thick test bars used in accordance with ASTM test protocols for both impact and tensile tests. The pellets were melted, and pressure injected into the mold under pressures of 1000 psi at barrel temperatures of 260 deg.C.

Cycle time was tested on a Cincinnati Milacron molding machine, 150 ton, 6 oz. Barrel temperature profile was maintained at temperatures of 480 deg.F., 500 deg.F., 520 deg.F., as measured from the hopper then in a forward direction. The nozzle temperature was 530 deg.F., and the injection pressure was about 1700 psi. Mold temperature was maintained to be between about 150 to 160 deg.F. The article molded and used in the evaluation of the cycle time of the process utilizing the novel compositions of the instant invention were irregularly shaped "dip stick" articles.

For all Examples 1–9, the mold retention time of the compositions was 3 seconds, as is outlined in Tables 2 and 3 following, which also list the physical properties of the compositions according to Examples 1–9. It is to be noted that like numbered "Examples" correlate with correspondingly numbered results from physical property test data.

TABLE 2

| Sample: | 1 | 2 | 3 | 4 | 5 |
|---|---|---|---|---|---|
| Screw rpm: | 220 | 220 | 150 | 220 | 220 |
| Feed rate (lbs/hr): | 25 | 55 | 25 | 25 | 55 |
| Izod: | 23.8 | 20.9 | 25.4 | 24.0 | 24.5 |
| Flex Str. (1000's): | 11.8 | 12.0 | 12.3 | 12.2 | 13.0 |
| Flex Modulus (1000's): | 290.2 | 299.2 | 311.4 | 307.5 | 331.4 |
| Tensile Yield (1000's): | 8.3 | 8.5 | 8.7 | 8.4 | 8.9 |
| Tensile Break (1000's): | 7.5 | 8.0 | 8.6 | 9.9 | 10.3 |
| Elongation Yield: | 5 | 5 | 5 | 5 | 5 |
| Elongation Break: | 104 | 150 | 192 | 253 | 243 |

TABLE 3

| Sample: | 6 | 7 | 8 | 9 |
|---|---|---|---|---|
| Screw rpm: | 150 | 220 | 220 | 220 |
| Feed rate (lbs/hr): | 25 | 25 | 55 | 25 |
| Izod: | 25.3 | 17.0 | 5.8 | 5.5 |
| Flex Strength (1000's): | 11.9 | 12.0 | 11.6 | 13.2 |
| Flex | 296.9 | 196.1 | 282.3 | 218.4 |

TABLE 3-continued

| Sample: | 6 | 7 | 8 | 9 |
|---|---|---|---|---|
| Modulus (1000's): | | | | |
| Tensile Yield (1000's): | 8.5 | 8.7 | 8.3 | 9.4 |
| Tensile Break (1000's): | 10.0 | 6.5 | 6.3 | 7.2 |
| Elongation Yield: | 15 | 5 | 5 | 5 |
| Elongation Break: | 243 | 43 | 61 | 98 |

As may be ascertained from inspecting the physical property results outlined in Tables 2 and 3, the compositions exhibit high impact strength, in conjunction with short mold retention times of the compositions in the die of the injection molding process. (This mold retention time may also be termed "cycle time".) The materials also exhibited good overall flexural and tensile test results. Overall properties were improved when a small amount of the Nylon-6 was replaced by Nylon-6,6 having predominant amine end group termination. The molded samples exhibited excellent mold release characteristics.

EXAMPLES 10–23

Compositions comprising the Nylons of Examples 1–9, Polynil 50, SURLYN 1801, PLEXAR 420, SMA 3000 and Acrawax C having the compositions outlined in Tables 4A and 4B were prepared and subsequently molded in the manner generally outlined for Examples 1–9.

TABLE 4A

| Sample: | 10 | 11 | 12 | 13 | 14 | 15 | 16 |
|---|---|---|---|---|---|---|---|
| Composition: | | | | | | | |
| Nylon-6 | 68.1 | 68.1 | 71.7 | 71.7 | 71.7 | 71.7 | 71.7 |
| Polynil 50 | 7.3 | 7.3 | 7.7 | 7.7 | 7.7 | 7.7 | 7.7 |
| SURLYN 1801 | 6 | 6 | 5 | 5 | 10 | 10 | 10 |
| PLEXAR 420 | 18 | 18 | 15 | 15 | 10 | 10 | 10 |
| SMA 3000 | 0.4 | 0.4 | 0.4 | 0.4 | 0.4 | 0.4 | 0.4 |
| Acrawax C | 0.2 | 0.2 | 0.2 | 0.2 | 0.2 | 0.2 | 0.2 |

TABLE 4B

| Sample: | 17 | 18 | 19 | 20 | 21 | 22 | 23 |
|---|---|---|---|---|---|---|---|
| Composition: | | | | | | | |
| Nylon-6 | 71.7 | 68.1 | 68.1 | 68.1 | 68.1 | 68.1 | 68.1 |
| Polynil 50 | 7.7 | 7.3 | 7.3 | 7.3 | 7.3 | 7.3 | 7.3 |
| SURLYN 1801 | 15 | 6 | 6 | 12 | 12 | 18 | 18 |
| PLEXAR 420 | 5 | 18 | 18 | 12 | 12 | 6 | 6 |
| SMA 3000 | 0.4 | 0.4 | 0.4 | 0.4 | 0.4 | 0.4 | 0.4 |
| Acrawax C | 0.2 | 0.2 | 0.2 | 0.2 | 0.2 | 0.2 | 0.2 |

As for the prior Examples 1–9, the compositions were fed at two different feed rates into a Leistritz twin-screw extruder in order to determine if variations in the melt processing of the components effected modifications in the resultant physical properties, notably the Izod impact values and to a lesser extent, the tensile and flexural test values. Test bars were produced in a manner conforming to that used in Examples 1–9. A summary of the test results for Examples 10–23 are listed in Tables 5A, 5B and 5C below.

TABLE 5A

| Sample: | 10 | 11 | 12 | 13 | 14 |
|---|---|---|---|---|---|
| Feed rate (lbs/hr): | — | — | 25 | 55 | 25 |
| Izod: | 5.1 | 9.7 | 22.1 | 18.8 | 17.8 |
| Flex Str. (1000's): | 10.3 | 12.3 | 11.8 | 11.4 | 12.0 |
| Flex Modulus (1000's): | 266.7 | 337.0 | 297.1 | 284.5 | 299.9 |
| Tensile Yield (1000's): | 8.1 | 9.2 | 9.1 | 8.8 | 9.0 |
| Tensile Break (1000's): | 7.3 | 8.1 | 10.2 | 8.9 | 10.0 |
| Elongation Yield: | 5 | 5 | 5 | 5 | 5 |
| Elongation Break: | 150 | 109 | 284 | 242 | 285 |

TABLE 5B

| Sample: | 15 | 16 | 17 | 18 | 19 |
|---|---|---|---|---|---|
| Feed rate (lbs/hr): | 55 | 25 | 55 | 25 | 55 |
| Izod: | 13.1 | 9.7 | 22.1 | 18.8 | 17.8 |
| Flex Str. (1000's) | 12.0 | 16 | 17 | 15 | 19 |
| Flex Modulus (1000's): | 296.8 | 299.7 | 283.8 | 290.1 | 273.3 |
| Tensile Yield: (1000's): | 9.0 | 8.7 | 8.6 | 8.4 | 8.0 |
| Tensile Break: (1000's): | 8.7 | 6.0 | 6.0 | 7.1 | 6.8 |
| Elongation Yield: | 5 | 5 | 5 | 5 | 5 |
| Elongation Break: | 238 | 136 | 129 | 100 | 112 |

TABLE 5C

| Sample: | 20 | 21 | 22 | 23 |
|---|---|---|---|---|
| Feed rate (lbs/hr): | 25 | 55 | 25 | 55 |
| Izod: | 24.1 | 22.3 | 23.0 | 18.6 |
| Flex Str. (1000's): | 11.3 | 11.2 | 11.8 | 11.4 |
| Flex Modulus (1000's): | 285.7 | 269.9 | 286.3 | 281.6 |
| Tensile Yield (1000's): | 8.2 | 8.2 | 8.3 | 8.5 |
| Tensile Break (1000's): | 7.4 | 6.3 | 10.0 | 8.8 |
| Elongation Yield: | 5 | 5 | 5 | 5 |
| Elongation Break: | 167 | 202 | 233 | 293 |

The results from Tables 5A, 5B and 5C illustrate that compositions having good impact properties, with values frequently in excess of 10 may be formulated, while retaining short mold retention times.

EXAMPLES 24–29

Compositions comprising the nylons used in Examples 1–9, Polynil 50, PLEXAR 420, SMA 3000 and Acrawax C were formulated to have the relative weight percentages outlined in Table 6. No SURLYN was utilized in the formulations. The constituents were mixed prior to processing in a manner corresponding to that used for Examples 1–9.

TABLE 6

| Sample: | 24 | 24 | 26 | 27 | 28 | 29 |
|---|---|---|---|---|---|---|
| Composition: | | | | | | |
| Nylon-6 | 69.8 | 69.4 | 59.8 | 59.4 | 69.8 | 69.4 |
| Polynil 50 | — | — | — | — | 10 | 10 |
| B-1 | 10 | 10 | 20 | 20 | — | — |
| PLEXAR 420 | 20 | 20 | 20 | 20 | 20 | 20 |
| SMA 3000 | — | 0.4 | — | 0.4 | — | 0.4 |
| Acrawax C | 0.2 | 0.2 | 0.2 | 0.2 | 0.2 | 0.2 |

As the results in the Table 7 summarize, the respective compositions which lacked the modified ethylene-methacrylic acid copolymers, i.e. SURLYNs, showed satisfactory, although lower impact resistance as noted and as may be contrasted against other Examples which included amounts of SURLYN as a constituent, and which is evidenced in the resultant values for the Izod impact tests.

TABLE 7

| Sample: | 24 | 24 | 26 | 27 | 28 | 29 |
|---|---|---|---|---|---|---|
| Izod: | 3.0 | 3.0 | 4.1 | 3.2 | 3.7 | 1.2 |
| Flex Str. (1000's): | 12.0 | 12.4 | 11.3 | 12.2 | 11.7 | 16.7 |
| Flex Modulus (1000's): | 321.4 | 324.7 | 301.2 | 326.0 | 302.2 | 430.5 |
| Tensile Yield (1000's): | 8.5 | 8.5 | 8.2 | 8.5 | 8.3 | 11.6 |
| Tensile Break (1000's): | 6.2 | 6.7 | 6.3 | 6.6 | 6.2 | 7.6 |
| Elongation Yield: | 5 | 5 | 5 | 5 | 5 | 5 |
| Elongation Break: | 82 | 88 | 85 | 30 | 80 | 117 |

EXAMPLES 30–40

Compositions comprising the nylons of Example 1–9, Polynil 50, SURLYN 1801, PLEXAR 420 and SMA 3000 in weight proportions as outlined in Tables 8A and 8B were prepared in accordance with the procedure for extruding and molding generally outlined for Examples 1–9.

TABLE 8A

| Sample: | 30 | 31 | 32 | 33 | 34 | 35 |
|---|---|---|---|---|---|---|
| Composition: | | | | | | |
| Nylon-6 | 75.3 | 75.3 | 75.3 | 71.7 | 71.7 | 71.7 |
| Polynil 50 | 8.1 | 8.1 | 8.1 | 7.7 | 7.7 | 7.7 |
| SURLYN 1801 | 4 | 8 | 12 | 5 | 10 | 15 |
| PLEXAR 420 | 12 | 8 | 4 | 15 | 10 | 5 |
| SMA 3000 | 0.4 | 0.4 | 0.4 | 0.4 | 0.4 | 0.4 |
| Acrawax C | 0.2 | 0.2 | 0.2 | 0.2 | 0.2 | 0.2 |

TABLE 8B

| Sample: | 36 | 37 | 38 | 39 | 40 |
|---|---|---|---|---|---|
| Composition: | | | | | |
| Nylon-6 | 68.1 | 68.1 | 68.1 | 68.5 | 62.4 |
| Polynil 50 | 7.3 | 7.3 | 7.3 | 7.3 | 10 |
| SURLYN 1801 | 6 | 12 | 18 | 6 | 6 |
| PLEXAR 420 | 18 | 12 | 6 | 18 | 21 |
| SMA 3000 | 0.4 | 0.4 | 0.4 | — | 0.4 |
| Acrawax C | 0.2 | 0.2 | 0.2 | 0.2 | 0.2 |

The corresponding physical properties of each of Examples 30–40 are summarized on Tables 9A and 9B.

TABLE 9A

| Sample: | 30 | 31 | 32 | 33 | 34 | 35 |
|---|---|---|---|---|---|---|
| Izod: | 6.3 | 5.2 | 4.6 | 19.3 | 18.8 | 18.8 |
| Flex Str. (1000's): | 11.9 | 11.9 | 12.0 | 11.6 | 11.5 | 11.5 |
| Flex Modulus (1000's): | 305.9 | 300.0 | 305.6 | 299.2 | 295.0 | 292.0 |
| Tensile Yield (1000's): | 4.0 | 8.9 | 9.0 | 8.3 | 8.5 | 8.4 |
| Tensile Break (1000's): | 8.6 | 10.3 | 8.5 | 6.4 | 9.9 | 9.6 |
| Elongation Yield: | 5 | 5 | 5 | 5 | 5 | 5 |
| Elongation Break: | 199 | 296 | 241 | 216 | 253 | 282 |

TABLE 9B

| Sample: | 36 | 37 | 38 | 39 | 40 |
|---|---|---|---|---|---|
| Izod: | 18.0 | 22.2 | 18.0 | 16.9 | 16.4 |
| Flex Str. (1000's): | 11.3 | 10.6 | 11.0 | 10.6 | 10.2 |
| Flex Modulus (1000's): | 292.3 | 269.4 | 282.6 | 267.7 | 262.4 |
| Tensile Yield (1000's): | 8.4 | 7.9 | 8.3 | 7.9 | 7.7 |

TABLE 9B-continued

| Sample: | 36 | 37 | 38 | 39 | 40 |
|---|---|---|---|---|---|
| Tensile Break (1000's): | 6.3 | 7.7 | 8.7 | 6.5 | 6.9 |
| Elongation Yield: | 5 | 5 | 5 | 5 | 5 |
| Elongation Break: | 252 | 284 | 220 | 229 | 190 |

As may be seen from the data tabularized on Tables 9A and 9B, the impact strength of compositions was found to be good when the total amount of the ethylene-methacrylic acid copolymer and the maleated ethylene-propylene copolymer is about 20% and shows further improvement when the total is about 24%.

EXAMPLES 41–58

Further compositions comprising nylons of Examples 1–9, Polynil 50, SURLYN 1801, PLEXAR 420 and Acrawax C were formulated. Additionally, the various compositions included further additives, including: amounts of magnesium oxide, and various grades of SMA's, specifically SMA 2000, SMA 2625 and SMA 3000. As noted above, these SMAs are materials described as being a low molecular weight copolymer of styrene and maleic anhydride in anhydride and in partial ester form.

Additionally, the amounts of Nylon-6,6 additives were alternated between "Polynil 50" and "Polynil 60". As noted above, "Polynil 50" is a Nylon-6,6 with predominantly amine end groups, while "Polynil 60" may be described as a Nylon-6,6 with a balanced ratio of amine end groups to acid end groups. The various compositions were prepared generally in accordance with the process utilized in the production of Examples 1–9. The compositions are listed in Tables 10A and 10B.

TABLE 10A

| Sample: | 41 | 42 | 43 | 44 | 45 | 46 | 47 | 48 | 49 |
|---|---|---|---|---|---|---|---|---|---|
| Composition: | | | | | | | | | |
| Nylon-6 | 62.6 | 64.1 | 55.1 | 66.2 | 51.1 | 59.7 | 59.7 | 55.6 | 62.2 |
| Polynil 50 | 10 | — | — | 10 | 15 | — | — | — | — |
| Polynil 60 | — | 10 | 15 | — | — | 10 | 10 | 10 | 10 |
| SURLYN 1801 | 6 | 2 | 6 | 2 | 6 | 6 | 6 | 6 | 6 |
| PLEXAR 420 | 21 | 21 | 21 | 21 | 25 | 21 | 21 | 25 | 21 |
| SMA 3000 | — | — | 0.4 | — | — | — | — | 0.4 | 0.8 |
| SMA 2625 | 0.4 | 0.4 | — | — | — | — | — | — | — |
| SMA 2000 | — | — | — | 0.8 | 0.4 | 0.8 | 0.8 | — | — |
| MgO | — | 2.5 | 2.5 | — | 2.5 | 2.5 | 2.5 | — | — |

TABLE 10B

| Sample: | 50 | 51 | 52 | 53 | 54 | 55 | 56 | 57 | 58 |
|---|---|---|---|---|---|---|---|---|---|
| Composition: | | | | | | | | | |
| Nyion-6 | 58.7 | 57.6 | 64.1 | 55.1 | 61.6 | 53.2 | 55.7 | 54.7 | 60.1 |
| Polynil 50 | — | — | — | — | 15 | — | 10 | 15 | 10 |
| Polynil 60 | 15 | 15 | 10 | 15 | — | 15 | — | — | — |
| SURLYN 1801 | 2 | 2 | 2 | 6 | 2 | 6 | 6 | 2 | 2 |
| PLEXAR 420 | 21 | 25 | 21 | 21 | 21 | 25 | 25 | 25 | 25 |
| SMA 3000 | 0.8 | — | — | 0.4 | 0.4 | — | 0.8 | — | 0.4 |
| SMA 2625 | — | — | 0.4 | — | — | 0.8 | — | 0.8 | — |
| SMA 2000 | — | 0.4 | — | — | — | — | — | — | — |
| MgO | 2.5 | — | 2.5 | 2.5 | — | — | 2.5 | 2.5 | 2.5 |

Corresponding physical test date for Examples 41–58 are listed on Tables 11A, 11B and 11C below.

TABLE 11A

| Sample: | 41 | 42 | 43 | 44 | 45 | 46 |
|---|---|---|---|---|---|---|
| Cycle Time (sec.): | 3 | 4 | 3 | 3 | 8 | 15 |
| Izod: | 22.7 | 3.6 | 5.9 | 5.2 | 5.9 | 9.0 |
| Flex Str. (1000's): | 11.1 | 10.9 | 10.4 | 11.7 | 9.8 | 10.7 |
| Flex Modulus (1000's): | 281.9 | 271.8 | 268.1 | 300.6 | 248.4 | 273.8 |
| Tensile Yield (1000's): | 7.6 | 7.8 | 7.2 | 8.1 | 6.9 | 7.3 |
| Tensile Break (1000's): | 8.1 | 6.6 | 6.7 | 6.5 | 6.7 | 5.6 |
| Elongation Yield: | 5 | 3 | 4 | 3 | 4 | 5 |
| Elongation Break: | 163 | 33 | 41 | 26 | 58 | 64 |

TABLE 11B

| Sample: | 47 | 48 | 49 | 50 | 51 | 52 |
|---|---|---|---|---|---|---|
| Cycle Time (sec.): | 3 | 3 | 7 | 6 | 6 | 6 |
| Izod: | 8.0 | 13.9 | 5.7 | 4.8 | 14.7 | 4.3 |
| Flex Str. (1000's): | 10.6 | 10.5 | 10.8 | 11.2 | 10.7 | 11.2 |
| Flex Modulus (1000's): | 272.2 | 261.3 | 283.4 | 285.7 | 275.9 | 279.7 |
| Tensile Yield (1000's): | 7.2 | 7.6 | 7.3 | 7.7 | 7.6 | 7.9 |
| Tensile Break (1000's): | 7.7 | 7.0 | 6.6 | 5.4 | 7.0 | 6.6 |
| Elongation Yield: | 6 | 5 | 1 | 1 | 5 | 2 |
| Elongation Break: | 112 | 109 | 11 | 14 | 130 | 13 |

TABLE 11C

| Sample: | 53 | 54 | 55 | 56 | 57 | 58 |
|---|---|---|---|---|---|---|
| Cycle Time (sec.): | 3 | 5 | 9 | 4 | 6 | 3 |
| Izod: | 5.3 | 7.1 | 5.3 | 4.7 | 5.6 | 4.7 |

TABLE 11C-continued

| Sample: | 53 | 54 | 55 | 56 | 57 | 58 |
|---|---|---|---|---|---|---|
| Flex Str. (1000's): | 9.9 | 11.2 | 9.6 | 10.0 | 9.6 | 10.2 |
| Flex Modulus (1000's): | 249.4 | 279.8 | 256.2 | 246.9 | 256.7 | 252.0 |
| Tensile Yield (1000's): | 7.8 | 8.5 | 5.9 | 7.8 | 7.2 | 7.6 |
| Tensile Break (1000's): | 6.9 | 7.0 | 7.1 | 6.6 | 6.4 | 6.8 |
| Elongation Yield: | 5 | 5 | 5 | 5 | 5 | 5 |
| Elongation Break: | 23 | 14 | 17 | 16 | 19 | 27 |

From the resultant physical property data, it has been observed that the use of MgO exhibited a detrimental effect upon the impact properties of the compositions. While not wishing to be bound by any theory, it is hypothesized that the MgO reacts with the maleated ethylene-propylene and detrimentally affects the grafting with the Nylon polymer. Accordingly, compositions comprising MgO exhibit much poorer impact properties than compositions without MgO. The data also shows that the results obtained with the alternate usages of SMA 3000, SMA 2000 or SMA 2625 had little effect upon the resultant physical properties. Further, the total amount of modifiers used as constituents to make up the compositions was seen to have an effect upon the resulting physical properties, particularly in the Izod impact test results

EXAMPLES 59–66

Compositions including and omitting amounts of Nylon-6,6 ("Polynil 60") having the respective compositions listed in Table 12 were produced in accordance with the procedure followed for the production of Examples 1–9 as outlined above. The constituent "Stanyl KS 200" is a type 4,6 Nylon.

TABLE 12

| Example: | 59 | 60 | 61 | 62 | 63 | 64 | 65 | 66 |
|---|---|---|---|---|---|---|---|---|
| Composition: | | | | | | | | |
| Nylon-6 | 74.8 | 74.2 | 67.3 | 66.76 | 67.3 | 66.76 | 7.44 | 7.44 |
| Polynil 60 | — | — | 7.5 | 7.44 | — | — | 66.76 | — |
| SURLYN 1801 | 4 | 4 | 4 | 4 | 4 | 4 | 4 | 4 |
| PLEXAR 420 | 21 | 21 | 21 | 21 | 21 | 21 | 21 | 21 |
| Stanyl | | | | | | | | |

TABLE 12-continued

| Example: | 59 | 60 | 61 | 62 | 63 | 64 | 65 | 66 |
|---|---|---|---|---|---|---|---|---|
| KS 200 | — | — | — | — | 7.5 | 7.44 | — | 66.76 |
| SMA 2625 | — | 0.6 | — | 0.6 | — | 0.6 | 0.6 | 0.6 |
| Acrawax C | 0.2 | 0.2 | 0.2 | 0.2 | 0.2 | 0.2 | 0.2 | 0.2 |

The resultant physical properties corresponding to Examples 59–66 are outlined in Tables 13A and 13B below.

TABLE 13A

| Example: | 59 | 60 | 61 | 62 |
|---|---|---|---|---|
| Izod: | 17.1 | 16.3 | 23.5 | 19.2 |
| Flex Str. (1000's): | 10.3 | 10.9 | 10.2 | 10.8 |
| Flex Modulus (1000's): | 254.0 | 264.2 | 245.4 | 267.6 |
| Tensile Yield (1000's): | 7.9 | 8.1 | 7.6 | 7.7 |
| Tensile Break (1000's): | 6.3 | 6.6 | 6.7 | 6.2 |
| Elongation Yield: | 5 | 5 | 5 | 5 |
| Elongation Break: | 178 | 96 | 160 | 149 |

TABLE 13B

| Example: | 63 | 64 | 65 | 66 |
|---|---|---|---|---|
| Izod: | 17.6 | 21.5 | 5.7 | 6.7 |
| Izod: | | | | |
| Flex Str. (1000's): | 10.5 | 10.5 | 11.4 | 11.2 |
| FIex Modulus (1000's): | 265.4 | 255.9 | 275.7 | 262.0 |
| Tensile Yield (1000's): | 8.4 | 7.7 | B.3 | 8.9 |
| Tensile Break (1000's): | 6.2 | 6.0 | 7.1 | 8.6 |
| Elongation Yield: | 5 | 5 | 5 | 25 |
| Elongation Break: | 18 | 78 | 62 | 52 |

As may be ascertained from the resultant physical test data as summarized on Tables 13A and 13B, the use of compositions comprising Nylon-6, and which comprised no other species, or one other specie of Nylon could be formulated and still exhibit excellent strength retentive properties in molded articles while preserving short cycle times necessary for molding articles.

EXAMPLES 67–72

Examples 67–72 comprise further compositions which include small amounts of Nylon-6,6 and Nylon-4,6 and which further omit the maleated ethylene-propylene blend. These compositions were produced in accordance with the procedure used in the production of Examples 1–9; particular constituents are tabularized in Table 14 below. The constituent "EEA 6169" is a copolymer of ethylene and ethyl acrylate which may be obtained from Union Carbide.

TABLE 14

| Sample: | 67 | 68 | 69 | 70 | 71 | 72 |
|---|---|---|---|---|---|---|
| Composition: | | | | | | |
| Nylon-6 | 79.4 | 78.9 | 78.9 | 78.9 | — | — |
| Polynil 60 | — | — | — | 0— | — | 78.9 |
| SURLYN 1801 | 20 | 20 | 20 | 18.5 | 18.5 | 18.5 |
| Stanyl | — | — | — | — | 78.9 | — |
| KS 200 | | | | | | |
| SMA 2000 | — | — | 0.6 | — | — | — |
| SMA 2625 | 0.6 | 0.6 | — | 0.6 | 0.6 | 0.6 |
| EEA 6169 | — | — | — | 1.5 | 1.5 | 1.5 |
| MgO | — | 0.5 | 0.5 | 0.5 | 0.5 | 0.5 |

Corresponding physical properties for Examples 67–72 are presented in Table 15.

TABLE 15

| Sample: | 67 | 68 | 69 | 70 | 71 | 72 |
|---|---|---|---|---|---|---|
| Cycle Time | 15 | 13 | 12 | 8 | — | — |
| Izod | 12.2 | 17.6 | 29.7 | 28.9 | 3.1 | 4.3 |
| Flex Str. (1000's): | 12.0 | 11.7 | 11.6 | 11.4 | 11.0 | 11.8 |
| Flex Modulus (1000's): | 298.3 | 284.9 | 281.2 | 273.8 | 252.7 | 273.7 |
| Tensile Yield (1000's): | 8.7 | 7.9 | 8.2 | 7.8 | 8.1 | 9.3 |
| Tensile Break (100's): | 10.9 | 11.1 | 10.99 | 10.7 | 7.4 | 8.8 |
| Elongation Yield: | 5 | 5 | 5 | 5 | 20 | 30 |
| Elongation Break: | 218 | 232 | 209 | 201 | 61 | 86 |

As indicated by the results on Table 15, good impact test results were achievable in compositions wherein the maleated propylene copolymer was omitted, however, the benefits of short mold residence times (i.e. cycle time) was diminished.

COMPARATIVE EXAMPLE 1

A series of experiments were carried out to determine the effect of tensile modulus of the maleated polyolefinic modifier on cycle time of a nylon blend of such materials. The non-elastomeric polypropylene modifier selected for use in the experiments was obtained from Quantum under the tradename "PLEXAR" and the elastomeric maleated polypropylene modifier selected for use in the experiments was obtained from Exxon Chemical Co. under the tradename "Exxelor VA 1803". The test compositions were fabricated and their flexural modulus and tensile modulus were determined using the procedures of Examples 1 to 9. For comparison purposes, the flexural modulus and tensile modulus of a blend of Plexar and Surlyn (the ethylene/acrylic acid copolymer in the blend) and a blend of Exxelor and Surlyn were also determined. The results are set forth in Table 16.

TABLE 16

| COMPOSITION | FLEXURAL MODULUS (psi) | TENSILE MODULUS (psi) |
|---|---|---|
| Plexar alone | 71,300 | 93,000 |
| Surlyn alone | 35,900 | 34,400 |
| Plexar/Surlyn (50/50) | 70,800 | 50,100 |
| Exxelor VA 1803/Surlyn (50/50) | 22,600 | 15,900 |

Exxelor was too soft to be injection molded by itself, so a comparison of 50/50 blends of Surlyn and Plexar and of Surlyn and Exxelor were evaluated. The modulus of the two blends differ by a factor of three. This is due to the elastomeric character (relatively low tensile modulus) of Exxelor versus the non-elastomeric character (relatively high tensile modulus) of Plexar.

Using the procedure of Examples 1 to 9, various blends of nylon 6, Surlyn, various other ingredients contained in the blends of Examples 1 to 9 and Plexar or Exxelor were formulated and their cycle times and impact properties were evaluated. The composition of blends and test results are set forth in the following Table 17.

TABLE 17

| COMPOSITION | A | B |
|---|---|---|
| Nylon 6 | 67.0 | 67.0 |
| B-1 | 7.3 | 7.3 |
| Plexar 420 | 12.0 | — |
| Exxelor VA 1803 | — | 12.0 |
| Surlyn 1801 | 12.0 | 12.0 |
| SMA 3000 MB 26% | 1.5 | 1.5 |
| Acrawax C | 0.2 | 0.2 |
| PROPERTIES | | |
| Izod (1/8 in) | 22.6 | 27.2 |
| Cycle Time | 3 sec. filled mold | 3 sec did not fill mold |

What is claimed is:

1. polymeric composition comprising:

a) a polyamide;

b) a polyolefinic modifier selected from the group consisting of polypropylene, propylene copolymers, polyethylene, ethylene copolymers, and blends thereof, wherein said polyolefinic modifier has a tensile modulus equal to or greater than about 30,000 psi at 25° C. and is grafted with a compound selected from the group consisting of maleic anhydride, itaconic anhydride, glycidyl methacrylate, acyl bislactams, oxazinones and oxazolines; and c) an ethylene/methacrylic acid copolymer which is partially neutralized with alkali or alkaline earth ions.

2. The polymeric composition according to claim 1 wherein said polyamide is selected from the group consisting of nylon 6, nylon 6,6, nylon 4,6, nylon 6/6,6 and mixtures thereof.

3. The polymeric composition of claim 2 wherein said polyamide is selected from the group consisting of nylon 6 and nylon 6,6.

4. The polymeric composition of claim 3 wherein said polyamide is nylon 6.

5. The polyemric composition of claim 1 wherein said tensile modulus is equal to or greater than about 70,000 psi.

6. The polymeric composition according to claim 5 wherein said tensile modulus is equal to or greater than about 50,000 psi.

7. The polymeric composition according to claim 1 wherein said polyamide has from about 70 to about 80 percent amine end groups and from about 20 to about 30 percent acid end groups.

8. The polymeric composition of claim 1 wherein said polyamide comprises from about 51 weight percent to about 90 weight of the composition.

9. The polymeric composition of claim 1 wherein said polyamide comprises from about 51 weight percent to about 75 weight percent of the composition.

10. The polymeric composition according to claim 2 wherein the composition comprises nylon 6,6 having an excess of amine terminal groups relative to the carboxylic acid end groups.

11. The polymeric composition of claim 5 wherein the composition comprises nylon 6,6 having a ratio of amine terminal groups relative to carboxylic acid end groups of at least about 60/40.

12. The polymeric composition of claim 1 wherein the composition comprises from about 5 weight percent to about 25 weight percent of a blend of propylene and ethylene having maleic anhydride grafted thereto and from about 0 weight percent to about 25 weight percent of an ethylene-methacrylate copolymer which is partially neutralized with alkali or alkaline earth ions.

13. The polymeric composition of claim 1 which further comprises a styrene-maleic anhydride copolymer.

14. The polymeric composition of claim 1 which exhibits shorter molding cycle time for forming articles therefrom than forming the same article from compositions comprised of polyamide having a maleated ethylene-propylene blend modifier having a tensile modulus less than 15,900 at 25° C.

15. The composition of claim 14 wherein said molding cycle time is equal to or less than 10 seconds.

16. The composition of claim 15 wherein said molding cycle time is equal to or less than about 5 seconds.

17. The composition of claim 16 wherein said molding cycle time is equal to or less than about 4 seconds.

18. A molded article comprising the polymeric composition according to claim 1.

19. The composition of claim 1 wherein said polyolefinic modifier is a blend of polypropylene and polyethylene or copolymers of ethylene, wherein said polyethylene or copolymers of ethylene are modified with maleic anhydride.

20. The composition of claim 19 wherein said polyolefinic modifier is a blend of polypropylene and a copolymer of polyethylene and 1-butene.

21. The composition of claim 1 wherein said polyamide is a mixture comprised of:

a) about 10 weight percent of polyamide having from about 70 to about 80 percent amine end groups and from about 20 to about 30 percent acid end groups; and b) about 90 weight percent of nylon having balanced end groups.

22. A polymeric composition comprising:

a) a polyamide;

b) a polyolefinic modifier selected from the group consisting of polypropylene, propylene copolymers, polyethylene, ethylene copolymers, and blends thereof, wherein said polyolefinic modifier has a tensile modulus equal to or greater than about 50,000 psi at 25° C. and is grafted with a compound selected from the group consisting of maleic anhydride, itaconic anhydride, glycidyl methacrylate, acyl bislactams, oxazinones and oxazolines; and c) an ethylene/methacrylic acid copolymer which is partially neutralized with alkali or alkaline earth ions.

23. The polymeric composition according to claim 22 wherein said tensile modulus is equal to or greater than about 70,000 psi.

24. The polymeric composition according to claim 22 wherein said tensile modulus is equal to or greater than about 85,000 to 90,000 psi.

* * * * *